United States Patent [19]

Clark, Jr.

[11] 4,450,690

[45] May 29, 1984

[54] THERMALLY POWERED, GRAVITATIONALLY ASSISTED HEAT TRANSFER SYSTEMS

[76] Inventor: Robert W. Clark, Jr., 2232 W. Joan de Arc Ave., Phoenix, Ariz. 85029

[21] Appl. No.: 456,592

[22] Filed: Jan. 10, 1983

[51] Int. Cl.[3] ..... F25B 1/00

[52] U.S. Cl. ..... 62/116; 62/333; 62/335; 62/467

[58] Field of Search ..... 62/116, 333, 335, 467 R, 62/500, 510

[56] References Cited

U.S. PATENT DOCUMENTS

| | | | |
|---|---|---|---|
| 3,577,880 | 5/1971 | Leslie | 62/86 |
| 3,699,779 | 10/1972 | Schlichtig | 62/467 R |
| 3,823,573 | 7/1974 | Cassady | 62/467 R |
| 4,281,969 | 8/1981 | Doub, Jr. | 62/510 |

*Primary Examiner*—Ronald C. Capossela

[57] ABSTRACT

Method and apparatus for transferring heat. A pair of closed loop heat transfer loops each includes a refrigerant, a condenser to remove heat from the refrigerant, and an evaporator which adds heat to the refrigerant from its associated heat source. Each loop also includes a chamber of a compressor which has a free piston common to both chambers. One of the chambers is located above the other so that in one of the two cycles of operation, thermal energy from a heat source of the loop including the upper chamber evaporates liquified refrigerant collected in a collector of the loop in the previous cycle of operation which vapor together with gravity acting on the free piston cause the piston to compress vaporized refrigerant of the other loop in the lower chamber. This compressed refrigerant is condensed by loss of heat to an associated heat sink and is collected in the collector of its loop. In the second cycle, liquified refrigerant in the collector of the loop including the lower chamber is vaporized in its evaporator by absorbing heat from its associated heat source. The vaporized refrigerant acts on the free piston to cause it to compress vaporized refrigerant in the upper chamber which refrigerant is condensed in its loop condenser and collected in its collector. Controls are provided to initiate the next cycle of operation at the completion of the preceding cycle.

15 Claims, 3 Drawing Figures

THERMALLY POWERED, GRAVITATIONALLY ASSISTED HEAT TRANSFER SYSTEMS

BACKGROUND OF THE INVENTION

1. Field of the Invention

This invention is in the field of thermally powered heat transfer systems, and more particularly relates to refrigeration systems which use heat to cool a structure. This invention incorporates a new general method of using the force of gravity as a positive force supplementing the use of heat to accomplish the cooling of a structure or the freezing of products. This invention actively utilizes two different heat sources having different temperatures, of which at least the lower temperature heat source is within the structure to be cooled or is the products to be frozen. This invention employs a new type of compressor capable of acting with positive compressive force in both of two possible compressive action directions and which employs the force of gravity as a positive force supplementing the use of heat in one of the two compressive action directions. This new general method and this invention are of major significance in this era of energy shortages because they permit relatively small temperature differences to be made useful in accomplishing the cooling of structures or the freezing of products.

2. Description of the Prior Art

Previous inventions in the field of thermally powered refrigeration systems used one of three general methods to cool a structure. One of these general methods, known as the absorption cycle, is dependent upon a refrigerant being soluble in an absorbent and upon that refrigerant being more soluble in that absorbent when pressure is increased, the increase in pressure being produced by heat from some heat source. For efficient operation absorption cycle systems require a temperature of at least 200° F. The general method used in the current invention is not related to the absorption cycle.

The second general method used in the field of thermally powered refrigeration systems involves the use of a single, external heat source as a source of power and various means of converting thermal energy into mechanical energy which is then transmitted by some means in a manner which drives the compressor of a traditional compressor cycle refrigeration system in a single direction. For efficient operation such systems require a temperature of at least 165°. The general method used in the current invention is only superficially related to such systems in that this invention, as do existing systems which use this second general method, uses an external heat source to vaporize a refrigerant and uses two heat transfer units which function as evaporators and two heat transfer units which function as condensers. Also, such existing systems and the current invention employ compressors but the design and method of operation of the new type of compressor employed in the current invention differ greatly from the design and method of operation of such existing system compressors. The current invention uses two heat sources as power sources rather than one to power the compressor and the power derived from one of these heat sources, the low temperature heat source, is supplemented by the force of gravity in one of the two directions of compressor action.

The third general method used in the field of thermally powered refrigeration systems is similar in most respects to that employed in the current invention and is described in detail in my prior U.S. Pat. No. 4,418,547 issued Dec. 6, 1983 entitled Thermally Powered Heat Transfer System. This invention differs from that described in that patent application in that in this invention the force of gravity is used as a supplemental source of power to enhance the power provided by the low temperature heat source in exerting compressive force in one of the two compressive action directions. Such use of the force of gravity as a power source permits the same refrigerant to be used in both of the two closed loop heat transfer systems incorporated in both this system and in my copending application and thus, this invention differs in that respect from the system of my copending application. In terms of performance the use of the force of gravity as a source of power in one of the two possible compressive action directions permits the current invention to achieve far lower temperatures in the structure to be refrigerated or in the products to be frozen than can be accomplished from any given high temperature heat source by the system of my copending application. Thus, the current invention can achieve temperatures of −40° F. or below utilizing a high temperature heat source in some cases below 100° F.

SUMMARY OF THE INVENTION

The present invention provides a thermally powered heat transfer system particularly adapted to the freezing of products and to the refrigeration of structures used to store frozen products, but it may also be utilized to provide cooling for homes or other structures from low grade heat sources having a temperature below 100° F. The system has an evaporator located within the structure to be refrigerated or in proximity to the products to be frozen, two condensers located within one or two natural or created heat sinks having a temperature normally higher than that of the structure or products to be refrigerated, a second evaporator located within an external heat source having a temperature always higher than the temperature of the heat sink, and a two cylinder or two chamber compressor capable of acting with positive compressive force in both of two possible compressive action directions. Compressive action is transmitted from one chamber to the other by means of a liquid piston contained within flexible diaphragms located within each chamber or cylinder and suitable piping connecting the two chambers or cylinders. One chamber or cylinder is located below the other chamber or cylinder and the distance between the two chambers or cylinders is a design variable and determines the extent to which the force of gravity is employed to cause compressive action in the downward direction of the piston. These evaporators, condensers and compressor cylinders or chambers are joined with necessary piping and electrically activated valves to form two closed loop heat transfer systems. One closed loop includes the evaporator within the structure to be cooled or refrigerated or in proximity to the products to be frozen, one of the two condensers, and the upper chamber or cylinder of the compressor and this closed loop is filled with a refrigerant. The second closed loop includes the second evaporator located within the higher temperature heat source, the second of the two condensers, and the lower chamber or cylinder of the compressor and this second closed loop is filled with a refrigerant which may or may not be the same refrigerant that fills the first closed loop. The compressor is constructed so that the refrigerant within one closed loop is kept separate from the refrigerant within the other closed loop. The choice of the refrigerant or refrigerants used within these closed loops is determined by their thermodynamic properties, by the specific temperature desired within the structure to be refrigerated or necessary to cool or freeze the products, by the temperature and temperature range of the heat sink, by the temperature and temperature range of the higher temperature heat source, and by the extent to which the force of gravity can be used most effectively to accomplish the desired reults. This in turn determines the vertical distance that separates the two chambers or cylinders of the compressor or in other words the vertical length of the liquid piston. When the vapor formed in the evaporator heated by the higher temperature heat source is permitted to flow into the lower chamber of the compressor and its pressure exceeds the downward pressure exerted by the vapor in the upper chamber of the piston plus the gravitational pressure of the liquid piston itself, it causes the lower flexible diaphragm to act with positive compressive force upon the vapor in the upper chamber, this positive compressive force being transmitted by the liquid piston and causing the vapor in the upper chamber to be forced into the associated condenser. When the upper chamber has been emptied of vapor, electrically activated valves controlled by switches activated by the completion of a piston stroke close the valve between the upper chamber and its associated condenser, open the valve between the upper chamber and its associated evaporator, close the valve between the lower chamber and its associated evaporator and open the valve between the lower chamber and its associated condenser. When the pressure of the vapor formed in the evaporator located within the lower temperature heat source which is the structure to be refrigerated or the products to be cooled or frozen plus the downward gravitation pressure of the liquid piston itself exceeds the pressure of the vapor in the lower chamber, positive compressive force is exerted upon the vapor in the lower chamber and it is forced into the associated condenser. When the lower chamber has been emptied of vapor, the switches controlling electrically activated valves cause this cycle to be repeated. Two heat sources, one of which is the structure or products to be refrigerated are thus employed, together with the force of gravity, to effect the refrigeration of that structure or those products. This invention utilizes the force of gravity to achieve very low temperatures in the structure or products to be refrigerated while permitting the higher temperature, external heat source to have a relatively low temperature, a temperature lower than that utilized as the power source in other thermal powered refrigeration systems. Such low temperature heat sources can thus be utilized instead of fuels or electric power in low temperature refrigeration systems as well as in other cooling systems.

It is therefore an object of this invention to provide a thermally powered heat transfer system which can be used for low temperature freezing of products or structures.

It is still another object of this invention to provide a new general method for the design of thermally powered heat transfer systems in which the force of gravity and two heat sources, one of which is within the structure or in proximity to the products to be refrigerated, are actively utilized to effect the refrigeration of that structure or those products.

It is still another object of this invention to provide a thermally powered refrigeration system which can be operated at low purchased energy cost.

It is still another object of this invention to provide a new and useful gravitationally assisted compressor capable of positive compressive action in both of two possible compressive action directions.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
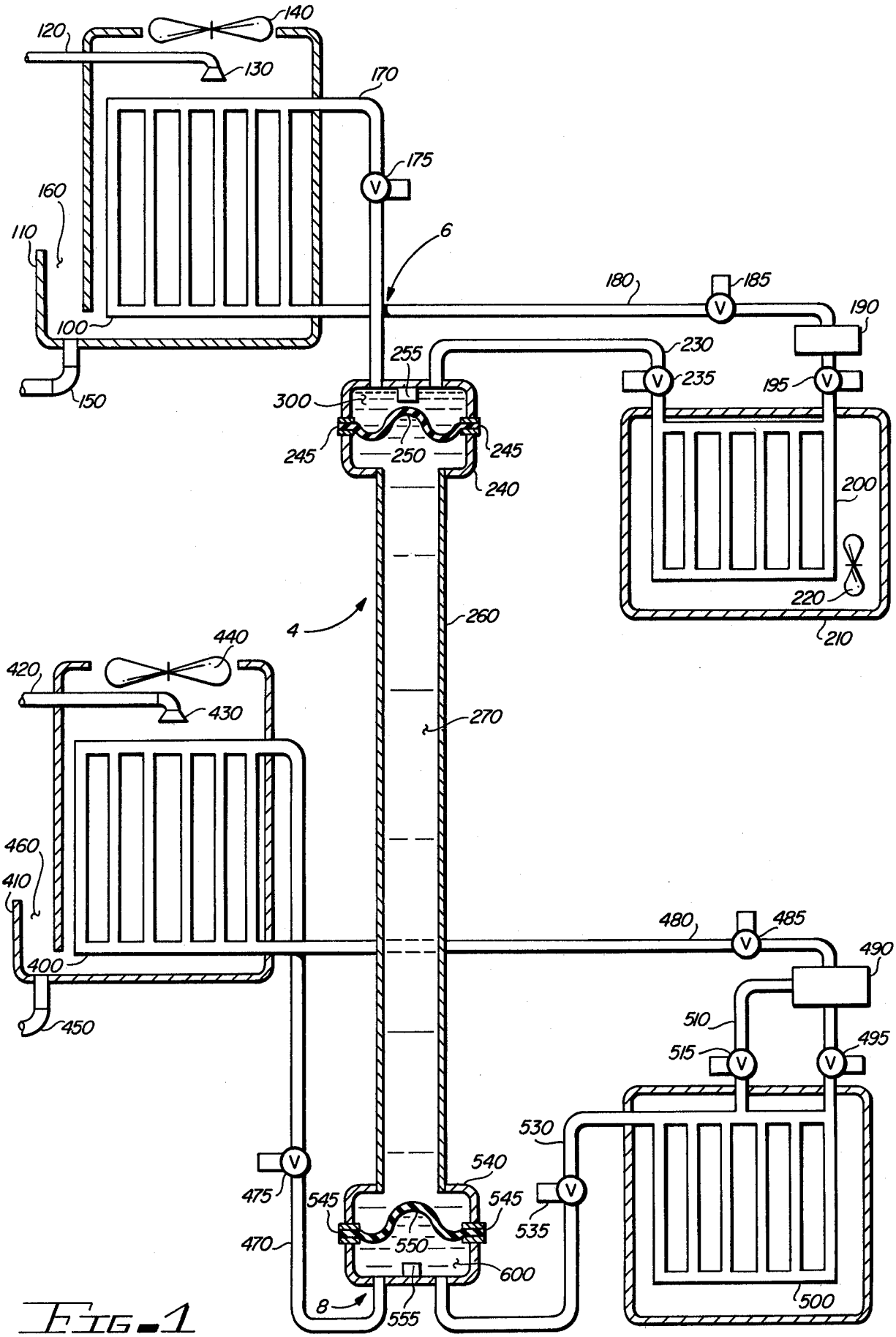
FIG. 1 is a schematic view of a preferred embodiment of the gravitationally assisted thermally powered refrigeration system embodying this invention in which the degree of gravitational assistance is fixed.

The thermally powered, gravitationally assisted refrigeration system 4 depicted in FIG. 1 consists of two closed loops, 6 and 8, each of which contains a refrigerant in both liquid and vapor states. Closed loop 6 consists of one or more evaporators 200 located within the structure 210 to be refrigerated and through which evaporator 200 air is circulated by means of fan 220. The top of evaporator 200 is connected by means of refrigerant vapor pipe 230 to the top of upper compressor chamber 240. Vapor flow through vapor pipe 230 is regulated by electrically activated valve 235. Refrigerant vapor pipe 170 connects the top of upper compressor chamber 240 to the top of condenser 100, vapor flow through vapor pipe 170 being regulated by electrically activated valve 175. The bottom of condenser 100 is connected to the bottom of evaporator 200 by means of refrigerant liquid pipe 180, liquid refrigerant flow through refrigerant liquid pipe 180 being regulated by electrically activated valves 185 and 195. The enlarged segment of refrigerant liquid pipe 180 between valves 185 and 195 is larger than the balance of this pipe and forms liquid refrigerant collector 190. A proximity switch 255 is located at the top of upper compressor chamber 240. Condenser 100 is depicted as being within evaporative cooler 110 consisting of water supply pipe 120, spray nozzle 130, fan 140, water outlet pipe 150 and air exhaust 160 but other means of cooling may be employed to effect heat transfer from condenser 100 within the spirit of this invention.

Closed heat transfer loop 8 consists of one or more evaporators 500 heated by some conventional heat source, solar, principal or waste water heat from a boiler, or heat from an internal combustion engine, etc. The top of evaporator 500 is connected by means of refrigerant vapor pipe 530 to the bottom of lower compressor chamber 540. Vapor flow through vapor pipe 530 is regulated by electrically activated valve 535. Refrigerant vapor pipe 470 connects the bottom of the lower compressor chamber 540 to the top of condenser 400, vapor flow through vapor pipe 470 being regulated by electrically activated valve 475. The bottom of condenser 400 is connected to the bottom of evaporator 500 by means of refrigerant liquid pipe 480, liquid refrigerant flow through refrigerant liquid pipe 480 being regulated by electrically activated valves 485 and 495. The enlarged segment of refrigerant liquid pipe 480 between valves 485 and 495 is larger than the balance of this pipe and forms liquid refrigerant collector 490. Refrigerant vapor pipe 510 connects the top of evaporator 500 to the top of liquid refrigerant collector 490, vapor flow through vapor pipe 510 being controlled by electrically activated valve 515. A proximity switch 555 is located at the bottom of the lower compresor chamber 540. Condenser 400 is depicted as being within evaporative cooler 410 consisting of water supply pipe 420, spray nozzle 430, fan 440, water outlet pipe 450, and air exhaust 460 but other means of cooling may be employed to effect heat transfer from condenser 400 within the spirit of this invention.

Piston liquid pipe 260 connects the bottom of upper compressor chamber 240 to the top of lower compressor chamber 540. Flexible diaphragm 250 is fastened to the sides of upper compressor chamber 240 by means of retaining ring 245 and flexible diaphragm 250 has a shape which conforms to either the surface of the upper portion or the surface of the bottom portion of upper compressor chamber 240 when fully extended in either direction. Flexible diaphragm 550 is fastened to the sides of lower compressor chamber 540 by means of retaining ring 545 and flexible diaphragm 550 has a shape which conforms to either the surface of the upper portion or the surface of the bottom portion of compressor chamber 540 when flexible diaphragm 550 is fully extended in either direction. Piston liquid 270 is contained within piston liquid pipe 260, flexible diaphragm 250, flexible diaphragm 550 and the walls of the two compressor chambers 240 and 540, the volume of piston liquid 270 being such as to fill liquid piston pipe 260 and either upper compressor chamber 240 or lower compressor chamber 540. Piston liquid 270 is free to move from the lower compressor chamber 540 to the upper compressor chamber 240 during one of the two cycles of operation when the refrigerant vapor 600 pressure exerted upon flexible diaphragm 550 exceeds the sum of the refrigerant vapor 300 pressure exerted upon flexible diaphragm 250 and the gravitational pressure exerted by piston liquid 270, and piston liquid 270 is likewise free to move from the upper compressor chamber 240 to the lower compressor chamber 540 during the other cycle when the opposite condition prevails. Piston liquid 270 thus constitutes a free piston. The operation of this free piston and the control of these two cycles of operation is regulated by the electrically activated valves and proximity switches 255 and 555.

Initially upper compressor chamber 240 is filled with refrigerant vapor 300, piston liquid pipe 260 is filled with piston liquid 270, water, ethylene glycol, or liquid mercury for example, and lower compressor chamber 540 is filled with piston liquid 270. Let us assume the height of the piston liquid column and the density of the liquid are such that a gravitational pressure equal to 10.133 PSIA is exerted by the liquid upon flexible diaphragm 550.

Both closed heat transfer loops 6 and 8 are depicted as utilizing evaporative cooling as a means of effecting the removal of heat from condensers 100 and 400. Let us assume that conditions exist such that refrigerant temperatures within the two condensers 100 and 400 are maintained at 60° F. Closed loop 6 which removes heat from the structure or products to be refrigerated must therefore have a vapor pressure at the desired low temperature sufficient, when assisted by the gravitational pressure exerted by piston liquid 270, to force vapor 600 from the lower compressor chamber 540 into condenser 400 and to cause its condensation at the assumed 60° F. internal condenser temperature. It is likewise necessary that evaporator 500, which obtains heat from a higher temperature heat source, have an evaporator 500 vapor pressure sufficient to overcome the gravitational pressure exerted by piston liquid 270 and likewise sufficient to force vapor from the upper compressor chamber 240 into condenser 100 and to cause its condensation at the assumed 60° F. internal condenser temperature.

To illustrate the operation of this invention let us now assume that both closed loops 6 and 8 are charged with Refrigerant 11, trichlorofluoromethane, and that the thermodynamic properties of this refrigerant are as specified by the E. I. duPont de Nemours and Company in its publication, "Thermodynamic Properties of Freon® 11 Refrigerant", copyrighted in 1965. The vapor pressure of this refrigerant at a temperature of 60° F., the assumed temperature of the refrigerant within condensers 100 and 400, is 10.876 PSIA. At start up it is assumed that refrigerant vapor 300 fills upper compressor chamber 240 and that piston liquid 270 fills lower compressor chamber 540. At this point proximity switch 555 is activated and causes valves 535, 515, 495, 175 and 185 to open and causes valves 475, 485, 195 and 235 to close. When the valves are in this position the evaporator 500 has an open refrigerant vapor pipe to lower compressor chamber 540 and upper compressor chamber 240 has an open refrigerant vapor pipe to condenser 100. Thus when the vapor pressure within evaporator 500 exceeds the combined pressures exerted by the vapor in condenser 100 (10.876 PSIA) and the gravitational pressure of piston liquid 270 (10.133 PSIA), refrigerant vapor will flow from evaporator 500 into lower compressor chamber 540 via refrigerant vapor pipe 530, and cause flexible diaphragm 550 to force piston liquid 270 from the lower compressor chamber 540 into upper compressor chamber 240. At a temperature 94° F. and any temperature above 94° F. the vapor pressure in evaporator 500 will exceed the downward pressure exerted upon flexible diaphragm 550 and will cause this upward movement of liquid piston 270 to occur. When piston liquid 270 fills the upper compressor chamber 240 flexible diaphragm 250 causes proximity switch 255 to be activated and this causes valves 535, 515, 495, 175 and 185 to close and valves 475, 485, 195 and 235 to open. When the valves are in this position the evaporator 200 has an open refrigerant vapor pipe to upper compressor chamber 240 and lower compressor chamber 540 has an open refrigerant vapor line to condenser 400. Thus, when the vapor pressure within evaporator 200 plus the gravitational pressure of piston liquid 270 (10.133 PSIA) exceeds the vapor pressure exerted by the vapor in condenser 400 (10.876 PSIA), refrigerant vapor will flow from evaporator 200 via refrigerant vapor pipe 230 and cause flexible diaphragm 250 to force piston liquid 270 from the upper compressor chamber 240 into lower compressor chamber 540.

At any temperature above −40° F., at which temperature refrigerant 11 has a vapor pressure of 0.743 PSIA, the vapor pressure in evaporator 200 will be sufficient to cause the downward movement of liquid piston 270 to occur. When the movement is completed proximity switch 555 is again activated and the next cycle is started by the closing of all open valves and the opening of all closed valves. Thus, with a condensing temperature of 60° F., a temperature of 94° F. or above can be used to achieve a low temperature down to −40° F. by utilizing the force of gravity.

During the first cycle of operation condenser 100 is connected to the vapor filled portion of upper compressor chamber 240 by means of refrigerant vapor pipe 170 and open valve 175 and vapor is forced to flow from upper compressor chamber 240 to condenser 100. As vapor condenses it flows by force of gravity through refrigerant liquid pipe 180 and through open valve 185 into liquid refrigerant collector 190, further movement being restricted by closed valve 195. During the second cycle of operation when the previously open valves are closed and the previously closed valves are opened, refrigerant liquid flows by force of gravity from liquid refrigerant collector 190 through the balance of refrigerant liquid pipe 180 and open valve 195 into the bottom of evaporator 200.

In like manner during the second cycle of operation system a condenser 400 is connected to the vapor filled portion of lower compressor chamber 540 by means of refrigerant vapor pipe 470 and open valve 475 and vapor is free to flow from lower compressor chamber 240 to condenser 400. As vapor condenses it flows by force of gravity through refrigerant liquid pipe 480 and through open valve 485 into liquid refrigerant collector 490, further movement being restricted by closed valve 495. At this point valve 515 which controls vapor flow from the top of evaporator 500 to the top of liquid refrigerant collector 490 through refrigerant vapor pipe 510 is also closed. During the first cycle of operation when the previously open valves are closed and the previously closed valves are opened, vapor flows from evaporator 500 through refrigerant vapor pipe 510 and open valve 515 into the top of liquid refrigerant collector 490, thus equalizing pressure and permitting refrigerant liquid to flow from liquid refrigerant collector 490 through the balance of refrigerant liquid pipe 480 and open valve 495 into the bottom of evaporator 500.

When a consistent condensing temperature can be maintained, the Thermally Powered, Gravitationally Assisted Heat Transfer System can be designed to achieve a desired specific low temperature by using a piston liquid pipe 260 of a given length together with a piston liquid 270 of a given density so as to utilize the force of gravity to a predetermined and fixed extent. The minimum temperature of the higher temperature heat source thus becomes known and is likewise fixed.

Figure 2:
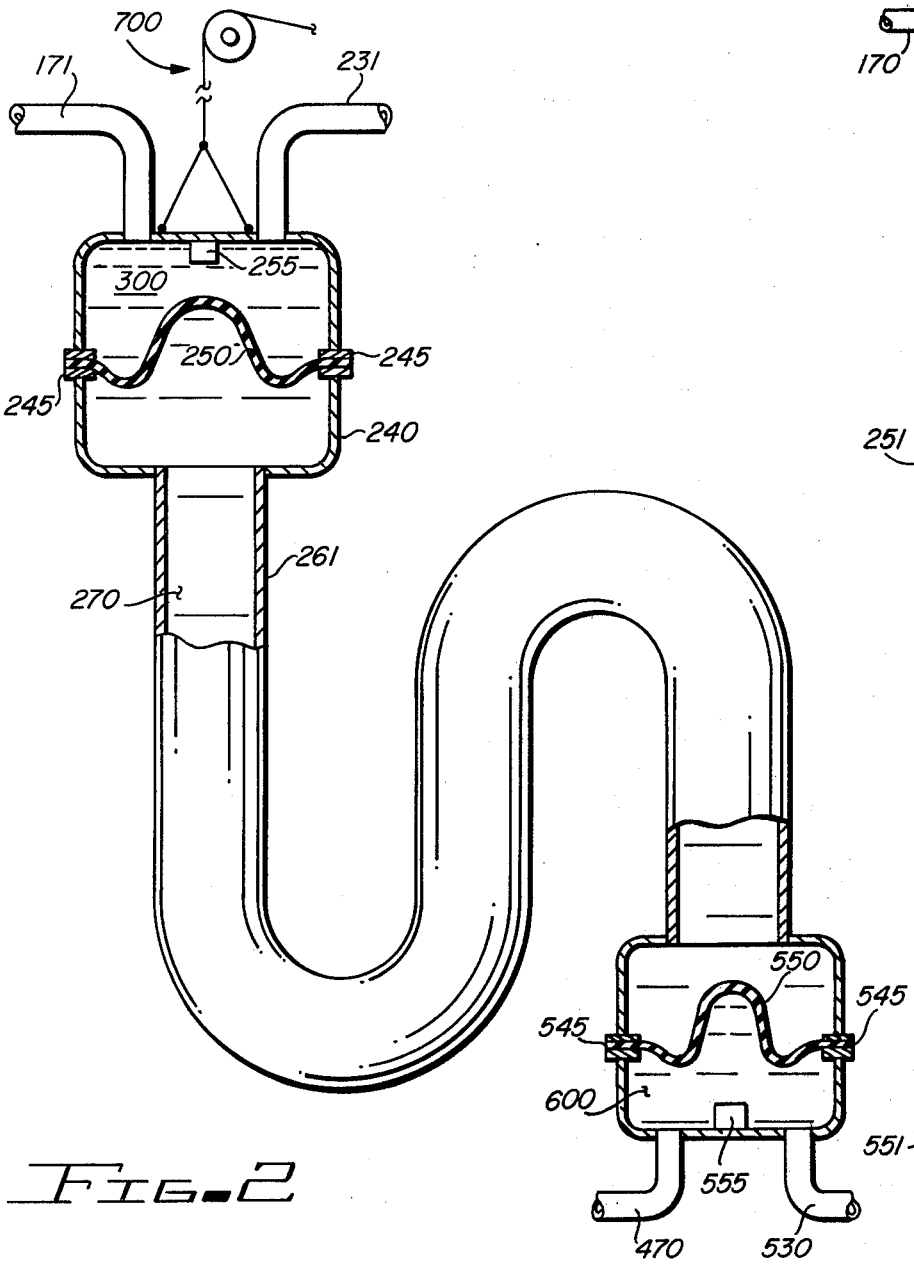
FIG. 2 is a schematic view of a preferred embodiment of the gravitationally assisted thermally powered refrigeration system embodying this invention in which the degree of gravitational assistance is variable.

When a consistent condensing temperature cannot be maintained but a specific low temperature is desired, the contribution of the force of gravity can be varied by replacing fixed vertical length piston liquid pipe 260 with a flexible piston liquid pipe or hose 261 illustrated in FIG. 2 and by providing some means, the particular means being immaterial to the spirit of this invention, of varying the vertical distance between the lower compressor chamber 540 and the upper compressor chamber 240, this variable vertical distance together with the density of the piston liquid 270 determining the extent of gravitational pressure. In FIG. 2 this mechanical means is depicted as a hoist 700 for purposes of illustration, this hoist raising or lowering upper compressor chamber 240 as condensing temperature increases or decreases. Under these conditions the desired low temperature can be obtained on a consistent basis so long as the high temperature heat source provides the minimum temperature required, a minimum temperature which will increase as condensing temperature increases and will decrease as condensing temperature decreases. Quite obviously when piston liquid pipe 260 is replaced with flexible piston liquid pipe or hose 261, refrigerant vapor pipes 170 and 230 must be replaced with flexible refrigerant vapor pipes or hoses 171 and 231.

To illustrate, if the refrigerant employed is again refrigerant 11 and if the condensing temperature within condensers 100 and 400 is lowered to 40° F., the vapor pressure within these condensers will be lowered to 7.022 PSIA. Under these conditions a gravitational force slightly above 6.279 PSIA will be necessary to achieve a temperature of −40° F. in the evaporator 200 and the temperature within evaporator 500 must be a minimum of only 70° F. to provide a vapor pressure in excess of 13.301 PSIA. If, however, the condensing temperature is 70° F. the vapor pressure within evaporators 100 and 400 will be 13.345 PSIA and a gravitational pressure slightly in excess of 12.602 PSIA will be necessary to achieve the low temperature of −40° F. in evaporator 200. Under these conditions the temperature within evaporator 500 must be a minimum of 106° F. to provide a vapor pressure in excess of 25.947 PSIA. This variation in gravitational pressure can be provided by varying the vertical distance between upper compressor chamber 240 and lower compressor chamber 540 as illustrated in FIG. 2.

Figure 3:
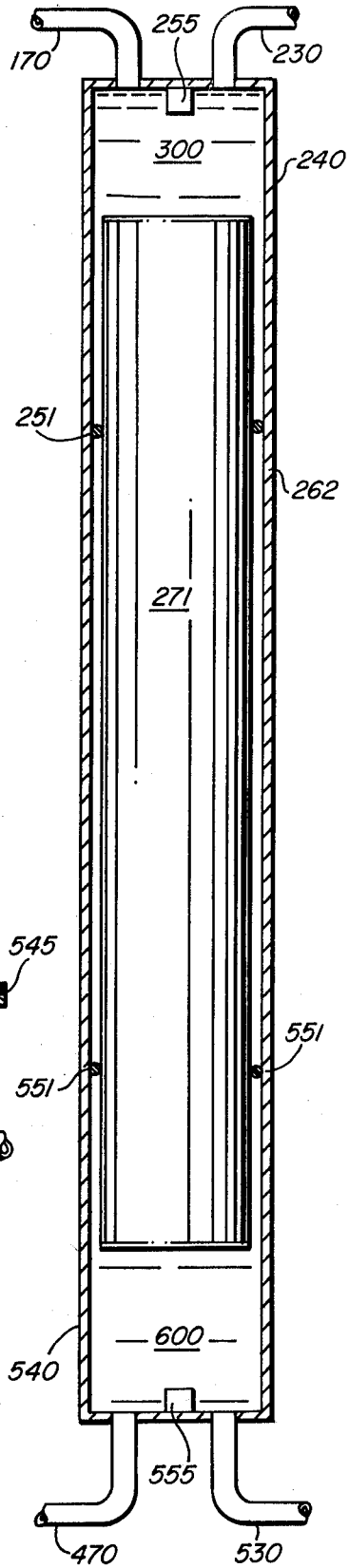
FIG. 3 is a schematic sectional view of a preferred embodiment of the compressor capable of compressive action in both of two possible compressive action directions, one of which is gravitationally assisted, in which the piston is a solid piston of a given or variable weight.

When a sufficiently consistent condensing temperature is assured or variation in the low temperature is acceptable, a solid piston of a given weight may be employed as illustrated in FIG. 3, and this solid piston arrangement may be substituted for the liquid piston arrangement illustrated in FIG. 1 without violating the spirit of this invention. In FIG. 3 a solid shaft 271 replaces piston liquid 270 in FIG. 1, seals 251 and 551 in FIG. 3 replace flexiable diaphragms 250 and 550 and replace retaining rings 245 and 545 in FIG. 1, and piston cylinder 262 replaces piston liquid pipe 260.

I claim:

1. A thermally powered heat transfer system having a first and a second cycle of operation, comprising:

first and second closed loop heat transfer means including respectively a first and a second refrigerant, a first and a second condenser means for transferring heat from the first and second refrigrant to a first and a second heat sink, and a first and a second heat exchanger means for transferring heat from a first and a second heat source to the first and second refrigerants;

compressor means for said first and second closed loop heat transfer means including a first chamber, a second chamber and a free piston common to both chambers, said first chamber being at a higher elevation than the second, said compressor means being powered by energy derived from the first heat source and gravity acting on said free piston for compressing the second refrigerant in the second chamber and for causing the second condenser means to transfer heat from the second refrigerant to the second heat sink during each first cycle of operation and being powered by energy derived from the second heat source acting on said free piston for compressing the first refrigerant in the first chamber and causing the first condenser means to transfer heat from the first refrigerant to the first heat sink during each second cycle of operation; and control means for causing the system to change its cycle of operation substantially at the completion of each cycle.

2. The thermally powered heat transfer system of claim 1 in which the free piston includes a liquid and a pair of flexible diaphragms.

3. The thermally powered heat transfer system of claim 2 in which the free piston is a solid.

4. The thermally powered heat transfer system of claim 2 in which the elevation of the first chamber above the second is variable.

5. The thermally powered heat transfer system of claim 4 in which the refrigerants in the first and second heat transfer means are the same material.

6. The thermally powered heat transfer system of claim 5 in which the heat sinks are evaporative coolers.

7. The thermally powered heat transfer system of claim 6 in which one of the heat sources includes means for producing heat from solar energy.

8. A thermally powered heat transfer system having a first and a second cycle of operation, comprising:

first and second closed loop heat transfer means including respectively a first and a second refrigerant, a first and a second condenser means for transferring heat from the first and second refrigerants to a first and a second heat sink, and a first and second heat exchanger means for transferring heat from a first and a second heat source to the first and second refrigerants;

first compressor chamber means between the first heat exchanger means and the first condenser means and through which the first refrigerant passes;

a second compressor chamber means between the second heat exchanger means and the second condenser means through which the second refrigerant passes;

means for mounting the first compressor chamber means at a higher elevation than the second;

free piston means common to both chamber means;

during each first cycle of operation of the system the first refrigerant expanding as a result of heat transferred to it from the first heat source, and together with gravity acting on the free piston means for compressing the second refrigerant in the second compressor chamber means and for causing the second condenser means to transfer heat from the compressed second refrigerant to the second heat sink;

during each second cycle of operation of the system the second refrigerant expanding as a result of heat transferred to it from the second heat source, acting on the free piston for compressing the first refrigerant in the first chamber means and causing the first condenser means to transfer heat from the compressed first refrigerant to the first heat sink; and control means for causing the system to change its cycle of operation substantially at the completion of each cycle.

9. A thermally powered heat transfer system of claim 8 in which the free piston includes a liquid.

10. The thermally powered heat transfer system of claim 9 in which the free piston further includes flexible diaphragm means.

11. The thermally powered heat transfer system of claim 10 in which the elevation of the first compressor chamber above the second compressor chamber is adjustable.

12. The thermally powered heat transfer system of claim 8 in which the free piston is a solid.

13. The thermally powered heat transfer system of claim 11 in which the first and second refrigerants are the same.

14. The thermally powered heat transfer system of claim 13 in which the heat sinks are evaporative coolers.

15. The method of transfering heat from first and second heat sources to a first and a second heat sink using a first and a second refrigerant and a compressor having a first and a second chamber with a free piston common to both chambers, said first chamber being positioned above the second, and said method having two cycles of operation, comprising the steps of:

A. during each first cycle of operation of:

1. evaporating the first refrigerant from a first collector within a first evaporator using heat from the first source;
2. compressing the second refrigerant in the second chamber using the evaporated first refrigerant and gravity acting on the free piston as the sources of energy;
3. transfering heat from the compressed second refrigerant to the second heat sink to liquify the second refrigerant;
4. collecting the liquified second refrigerant in a second collector; and
5. initiating the second cycle of operation when substantially all the second refrigerant capable of being forced out of the second chamber has been forced out of the second chamber; and B. during each second cycle of operation of:

1. evaporating the second refrigerant from a second collector within a second evaporator using heat from the second heat source;
2. compressing the first refrigerant in the first chamber using the evaporated second refrigerant acting on the free piston as the source of energy;
3. transfering heat from the compressed first refrigerant to a first heat sink to liquify the first refrigerant;
4. collecting the liquid refrigerant in the first collector; and
5. initiating the first cycle of operation when substantially all the first refrigerant capable of being forced out of the first chamber has been forced out of the first chamber.

* * * * *